US012172091B1

(12) United States Patent
Eddy et al.

(10) Patent No.: US 12,172,091 B1
(45) Date of Patent: Dec. 24, 2024

(54) AMUSEMENT DEVICE WITH PERMANENT MAGNET GAMEPLAY FEATURE

(71) Applicant: STERN PINBALL, INC., Elk Grove Village, IL (US)

(72) Inventors: Brian Eddy, Elk Grove Village, IL (US); Jim Novy, Elk Grove Village, IL (US)

(73) Assignee: Stern Pinball, Inc., Elk Grove Village, IL (US)

( * ) Notice: Subject to any disclaimer, the term of this patent is extended or adjusted under 35 U.S.C. 154(b) by 686 days.

(21) Appl. No.: 17/354,764

(22) Filed: Jun. 22, 2021

Related U.S. Application Data

(60) Provisional application No. 63/044,167, filed on Jun. 25, 2020.

(51) Int. Cl.
*A63F 7/02* (2006.01)
*A63F 7/00* (2006.01)

(52) U.S. Cl.
CPC ..... *A63F 7/027* (2013.01); *A63F 7/0088* (2013.01)

(58) Field of Classification Search
CPC ..... A63F 7/025; A63F 7/027; A63F 7/0088; A63F 2007/0094
See application file for complete search history.

(56) References Cited

U.S. PATENT DOCUMENTS 2,258,329 A 10/1941 MacDougall et al.
4,373,725 A 2/1983 Ritchie
5,338,031 A 8/1994 Patla, Sr. et al.
5,351,954 A * 10/1994 Oursler ..... A63F 7/027 273/127 R
5,356,142 A * 10/1994 Borg ..... A63F 7/027 273/121 A
5,415,402 A * 5/1995 Morrison ..... A63F 7/027 273/121 A
5,415,403 A * 5/1995 Ritchie ..... A63F 7/3075 273/127 R
5,452,894 A * 9/1995 Hansen ..... A63F 7/027 273/127 R
5,533,726 A * 7/1996 Nordman ..... A63F 7/027 273/121 D
5,558,327 A * 9/1996 Hansen ..... A63F 7/027 273/127 R
5,580,052 A * 12/1996 Popadiuk ..... A63F 7/027 273/127 R
5,664,775 A * 9/1997 Kao ..... A63F 7/027 273/121 A
5,673,913 A * 10/1997 Toler ..... A63F 7/027 273/121 A
6,158,737 A 12/2000 Cornell et al.
9,561,429 B2 2/2017 Gomez et al.
(Continued)

*Primary Examiner* — Raleigh W Chiu
(74) *Attorney, Agent, or Firm* — Greenberg Traurig LLP

(57) ABSTRACT

A magnet assembly for an amusement device, such as a pinball machine includes a permanent magnet coupled to a play surface of the device. The permanent magnet is movable between a first position, where the permanent magnet is proximate the play surface and a second position, where the permanent magnet is distally located from the play surface. The permanent magnet is movable by an actuator coupled to a linkage assembly to move the permanent magnet between the first position and the second position.

16 Claims, 7 Drawing Sheets

(56) References Cited

U.S. PATENT DOCUMENTS

| | | | | |
|---|---|---|---|---|
| 2006/0016287 | A1* | 1/2006 | Grossman | F16H 59/0204 74/473.21 |
| 2007/0026918 | A1 | 2/2007 | Sheats, Jr. | |
| 2016/0121203 | A1* | 5/2016 | Gomez | A63F 7/3075 273/118 A |

* cited by examiner

AMUSEMENT DEVICE WITH PERMANENT MAGNET GAMEPLAY FEATURE

CROSS REFERENCE TO RELATED APPLICATION

This application is a non-provisional application claiming priority from U.S. Provisional Application Ser. No. 63/044,167, filed Jun. 25, 2020, and incorporated herein by reference in its entirety.

FIELD OF THE DISCLOSURE

The present disclosure relates generally to amusement devices and more particularly to an amusement device with a permanent magnet gameplay feature.

BACKGROUND OF RELATED ART

Amusement game devices, such as pinball machines, redemption games, etc. of the commercial, e.g., revenue generating, and non-commercial, e.g., home entertainment, type are well known in the art. By way of example, U.S. Pat. Nos. 5,338,031, 6,158,737, and U.S. Published Application No. 2007/0026918 illustrate and describe amusement game devices of the type having a cabinet which houses a playfield.

Pinball machines have utilized electromagnet gameplay features in the past. Electromagnets are typically used in pinball machines to provide controllable, selective magnetic utilization and to prevent magnetization of a ferroelectric ball that comes into contact with or proximity of the magnet during prolonged, normal use, such as if the magnet were a permanent magnet. For instance, U.S. Pat. No. 2,258,329 describes a pinball game with a magnetizable ball and a plurality of electromagnets located underneath the playfield. The electromagnets are energized by switches located on a playfield in response to contact with the ball. U.S. Pat. No. 4,373,725 describes a pinball machine having an electromagnet located adjacent an entry port to an exit lane. The electromagnet is manually operable to energize and afford the player an opportunity to attract the ball which is susceptible to magnetic attraction, away from the entry port preventing the ball from being lost through the exit lane. U.S. Pat. Nos. 5,351,954, 5,356,142, 5,415,403, 5,580,052, 5,673,913, and 9,561,429 describe various other electromagnet game features.

While the various electromagnet gameplay features generally work for their intended purpose, there is an identifiable desire for improvements to these features.

BRIEF DESCRIPTION OF THE DRAWINGS

For a better understanding of the rotatable ball momentum transfer assembly disclosed hereinafter reference may be had to the following drawings.

DETAILED DESCRIPTION

The following description of example methods and apparatus is not intended to limit the scope of the description to the precise form or forms detailed herein. Instead the following description is intended to be illustrative so that others may follow its teachings.

With reference to the figures, an amusement game device, in the example form of a pinball machine 10 is now described. It is to be appreciated, however, that this example form for the amusement game device is not intended to be limiting. Rather, those of ordinary skill in the art will appreciated that the example ramp assembly disclosed hereinafter can be utilized in any type of amusement game device of the commercial and non-commercial type in which it is desired to create a ramp as disclosed.

Figure 1:
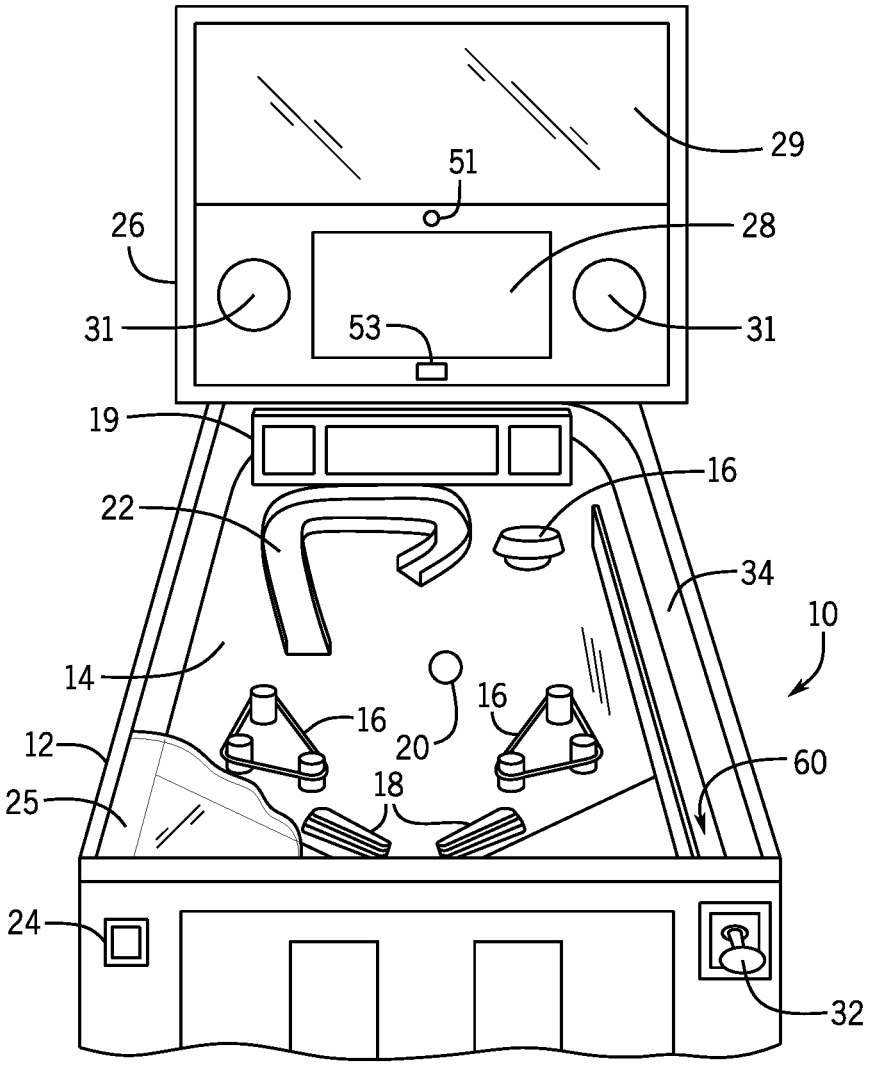
FIG. 1 illustrates an example amusement game device in the form of a pinball machine including an example of the disclosed enhanced ramp.

The example pinball machine 10 illustrated in FIG. 1 includes a cabinet 12 which houses various apparatus used to define play of a game (e.g., "gameplay"). Gameplay may be commenced in response to insertion of money, paper or coins referred to collectively as "coins", into a coin accepting device, upon exercising of credits earned, by accepting payment from an account, e.g., via use of a swipe card reading device, a bar code reading device, a QR code reading device, a near field communications device, etc., and/or by otherwise making game play active, including free play. Upon activation of the game in this manner, gameplay, in the case of the example pinball machine 10, is defined upon an inclined playfield 14 that supports a number of playfield elements, accessories, and/or devices.

More particularly, in the case of the example pinball machine 10, gameplay is generally defined through the use of a pair of pivotable, lower flippers 18 to propel a ball 20 for movement relative to an upper side (e.g., a top surface) of the playfield 14 and input devices/accessories associated with the playfield 14. In this example the playfield 14 also includes a backpanel 19 located near an upper portion of the playfield 14 away (e.g. distally located) from the player and the lower flippers 18. In this example, the backpanel 19 stands upright (e.g., vertical) from the playfield 14 and includes a ramp 22 adjacent the backpanel 19 and configured to allow for the ball 20 to be lifted off the playfield 14 as will be described in detail below. While generally described as being horizontal, the playfield 14 is usually inclined from the horizontal, such as for instance between approximately 6.5 to 7.0 degrees, such that the ball tends to eventually roll back down the playfield 14 in the direction of the lower flippers 18. While not intended to be limiting, the playfield accessories or input devices may include elements such as bumpers 16, targets (e.g. drop bank targets, spinner targets, etc.; not shown), and a permanent magnet assembly 50 which will be described in greater detail hereinafter.

The playfield 14 may be covered by a transparent or glass sheet cover 25 to permit viewing of the playfield 14. In addition to the foregoing, the playfield 14 typically includes a plunger element 32 which shoots or launches the ball 20 up an alley 34 onto the playfield 14. The playfield 14 may also include lighting elements—which may also be included as a part of the any of the input devices/accessories—and/or other features as desired. Other player-activated input elements, typically in the form of push-buttons (not shown) on the sides (or other location) of the cabinet 12, are usually provided for controlling operation of the lower flippers 18 or otherwise interacting with gameplay. The pinball machine 10 may also include a backbox 26 which is mounted to overlay a top rear portion of the cabinet 12 and which in this example contains artwork 29, and a display 28, such as a dot matrix display, CRT, LED or plasma display, or the like. The backbox 26 may also support speakers 31 associated with the game sound system. Within the backbox 26 may be located various ones of the electronic devices/circuits for controlling the operation of the playfield 14, the display 28, general illumination, and the sound system, including the speakers 31 and any additional sound system components. Such electronic devices/circuits could also, in whole or in part, be carried within the cabinet 12, or may be external to the game cabinet and linked to the pinball machine 10 via any suitable wired or wireless configuration.

Figure 2:
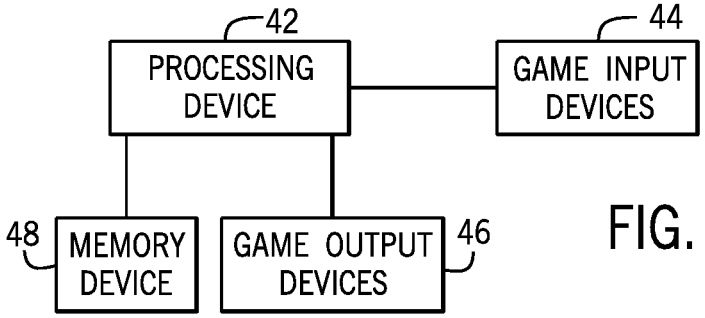
FIG. 2 is an example block diagram of example components of the amusement game device of FIG. 1.

Referring to FIG. 2, for controlling the various devices that form the amusement game, the example pinball machine 10 is provided with a processing device 42 which processing device 42 is, in turn, coupled to game input devices 44, such as switches associated with the cabinet 12 or the playfield 14, and game output devices 46, such as lights (including lights associated with the playfield), the bumpers 16, the lower flippers 18, the display 28, etc. via one or more bus systems. A memory device 48, such as a RAM, ROM, or the like, stores instructions and data usable by the processing device 42 to control gameplay, the game output devices 46, and the game input devices 44 as necessary based upon signals provided by the game input devices 44. It is to be understood that this illustrated embodiment is not intended to be limiting and that other manners for arranging the devices illustrated in FIG. 2 to provide for control of play of the amusement game can be utilized as needed.

Turning now to FIGS. 3-7C, disposed upon the playfield 14 is one or more gameplay accessories, targets, spinners, etc, including the example permanent magnet assembly 50 and, in this example, the ramp 22 to allow a ball to access the permanent magnet assembly 50 in some gameplay situations. It will be appreciated by one of ordinary skill in the art that while the example permanent magnet assembly 50 is described in relation to the backpanel 19 of a typical pinball machine and the permanent magnet assembly 50 is accessible during gameplay via the ramp 22, the principles of operation of the example permanent magnet assembly 50 may be utilized and/or located in conjunction with other features of the pinball machine 10, including for instance the playfield 14, and furthermore, the permanent magnet assembly 50 may be accessible via any suitable structure and/or feature, including for instance flippers, other ramps, alleys, targets, toys, or other suitable items. Accordingly, the example pinball machine 10 disclosed herein provides for a permanent magnet solution that still provides a selective, controllable magnetic feature, while reducing the likelihood of any magnetization of the ferroelectric ball utilized within the machine. As will further be appreciated, by utilizing a permanent magnet, the machine power requirements typically associated with powering an electromagnet are reduced.

Figure 4A:
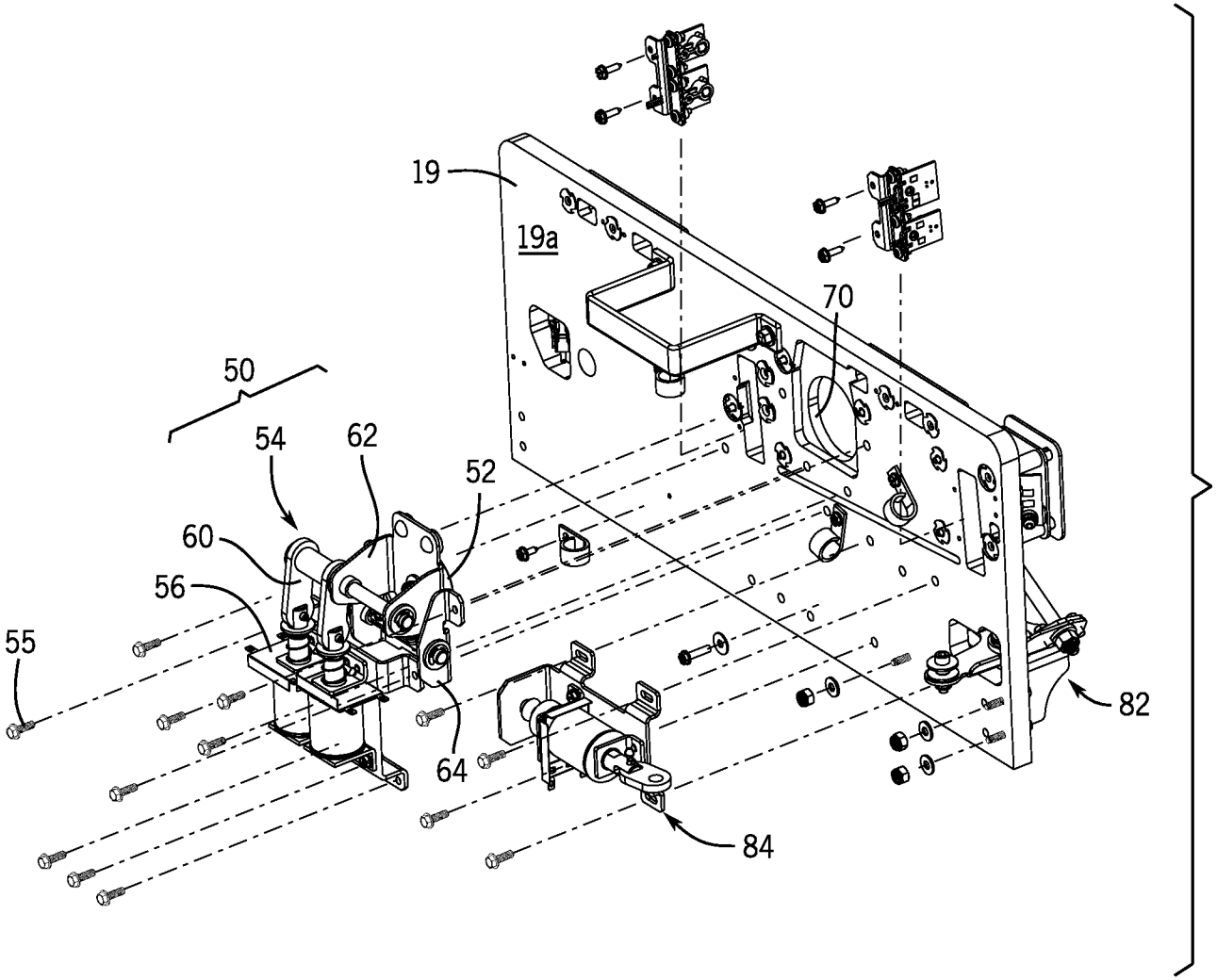
FIG. 4A is a perspective, exploded view of a rear side of the example pinball playfield of FIG. 3.
Figure 7A:
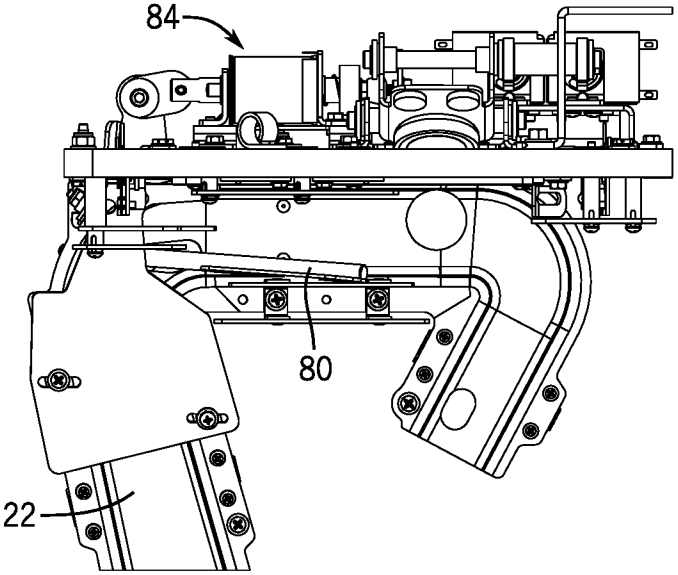
FIG. 7A is a top plan view of the example pinball playfield of FIG. 3 showing the deflector in a normal, rest position and the magnet in an activated position.
Figure 7B:
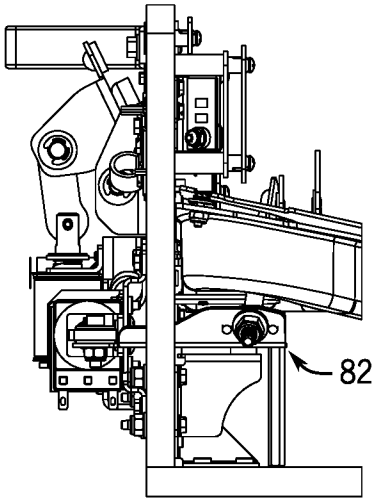
FIG. 7B is a side elevational view of FIG. 7A.
Figure 7C:
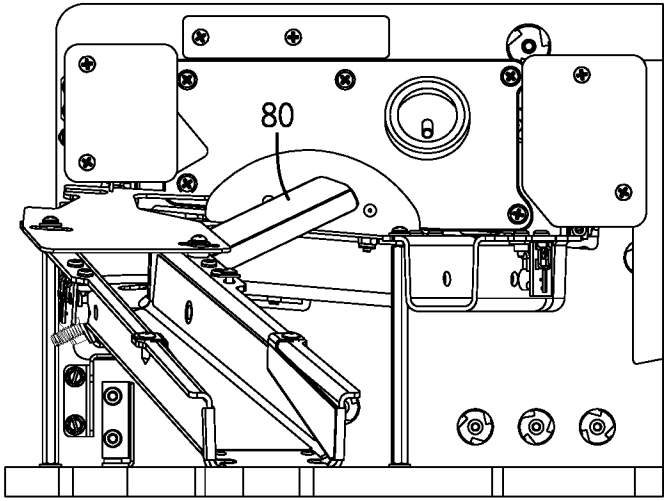
FIG. 7C is a front elevational view of FIG. 7A.

Returning to the figures, and more particularly FIG. 4A, the example permanent magnet assembly 50 comprises a permanent magnet 52 pivotally coupled to a backside 19*a* (non-playfield side) of the backpanel 19 of the pinball machine 10 via a pivoting linkage 54. The example pivoting linkage 54 comprises an actuator such as a coil assembly 56 (e.g., a solenoid and plunger assembly) mounted to the backside 19*a* of the backpanel 19 via a plurality of fasteners 55. The first linkage 60 is coupled to a first linkage 60 that is rotatably coupled to a plate 62. The plate 62 supports the permanent magnet 52. The plate 62, in turn, is coupled to a mount 64 that is also mountable to the backside 19*a* of the backpanel 19 via the fasteners 55. As illustrated, in this example the pivoting linkage 54 is activatable to move the first linkage 60 and thereby pivot the permanent magnet 52 between a first position, e.g., a normal, rest position as shown in FIGS. 4A, 5A-5C, and 6A-6C, and a second position, e.g., an activated position as illustrated in FIGS. 7A-7C.

In the illustrated example, the backpanel 19 comprises a hollow 70 sized and arranged to contain the permanent magnet 52 when the pivoting linkage 54 is in the first position. It will be understood that the permanent magnet 52 may or may not be visible through the backpanel 19 and moreover the depth of the hollow 70 may be modified to vary the location of the permanent magnet 52 relative to the backpanel 19. IN some instances, the hollow 70 may extend through the backpanel 19.

Figure 3:
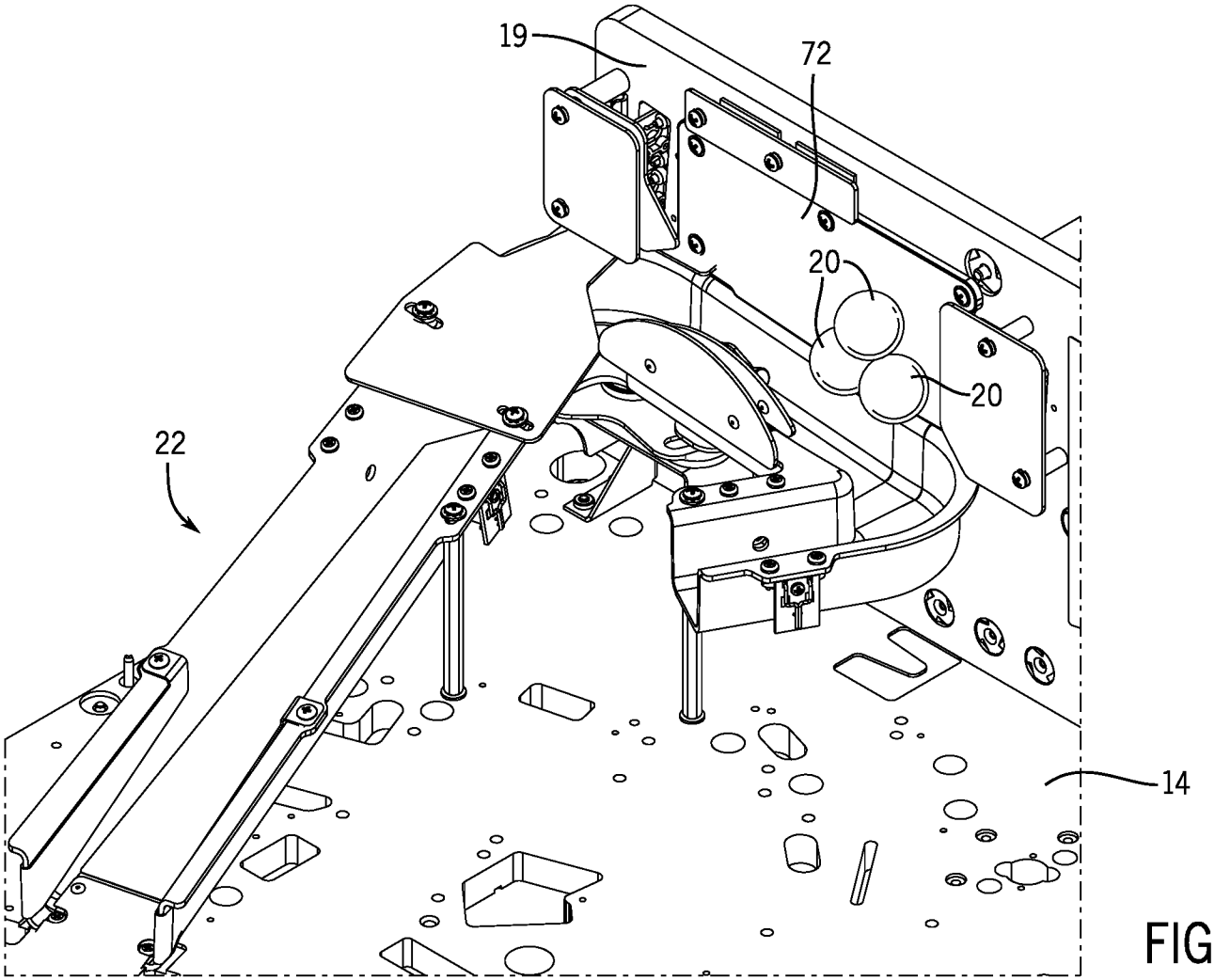
FIG. 3 is a perspective view of an example pinball playfield, including a ramp proximate a permanent magnet gameplay feature.

In operation, the example illustrated permanent magnet assembly 50 is biased towards the first position in which the permanent magnet 52 is within the hollow 70, adjacent the backside 19*a* of the backpanel 19, or otherwise proximate the backpanel 19. In this manner, any ball 20 that comes within operational distance of the permanent magnet 52 will be retained by the permanent magnet 52 (see for instance FIG. 3 and FIGS. 5A-5C). In the illustration of FIG. 3, the ball 20 is retained against a backpanel magnet cover 72 mounted to the backpanel 19 over the hollow 70. The example permanent magnet assembly 50 is biased towards the first position by a spring 74 coupled to a solenoid plunger 76 of the coil assembly 56. As will be appreciated, activation of the coil assembly 56 will cause the solenoid plunger 76 to be retracted within the coil assembly 56, thereby pivoting the permanent magnet 52 away from the first position and towards the second position. Thus, during gameplay, the processing device 42 may selectively activate or deactivate the coil assembly 56 to retain or release the ball 20 as desired.

As disclosed, the backpanel 19 of the pinball machine 10 is normally oriented in a generally vertical direction relative to the support surface, e.g., the playfield 14, which is typically slightly inclined relative to horizontal. In this example, the permanent magnet 52 is pivotally arranged such that in the first position, the permanent magnet 52 rests proximate the backpanel 19, and in the second position, the permanent magnet 52 is withdrawn, or pivoted away from the backpanel 19. In particular, in the illustrated example, when the solenoid plunger 76 is extended, the permanent magnet 52 is pivoted by the pivoting linkage 54 to the first position. Alternatively, when the solenoid plunger 76 is retracted by the coil assembly 56, the permanent magnet 52 is pivoted by the pivoting linkage 54 away from the backpanel 19 and to the second position.

In addition, as noted above, while the permanent magnet assembly 50 is mounted to the backpanel 19, the permanent magnet assembly 50 may be mounted to other game features, including the playfield 14, and/or other ramps, other targets, the game cabinet, or other suitable game features as desired. Still further, it will be appreciated that the permanent magnet assembly 50 and more particularly the pivoting linkage 54 may be any suitable lever assembly for any desired movement profile (e.g., pivoting, straight line movement, rotation, etc.) as desired or as needed for space requirements, such as for movement in a confined space.

It will be further understood from the present disclosure that the operating position of the permanent magnet may be in the typical line of travel of the ferroelectric ball during normal gameplay, thereby always having the potential to influence the ball. For instance, the permanent magnet may be placed directly within the normal travel path of the ball during normal gameplay to capture and retain, or otherwise influence the path of the ball.

In the illustrated example, however, the operating position of the permanent magnet is located outside of the normal travel path of the ball during normal gameplay, namely over the playfield 14. Thus, as illustrated in FIG. 3, the ramp 22 is configured to transport the ball 20 such that the ball 20 traverses the ramp 22 to travel proximate the location of the permanent magnet 52 relative to the backpanel 19. Still further, it will be appreciated that in this illustrated example, the operating position of the permanent magnet 52 is located vertically above the normal travel path of the ball 20 even as it moves through the ramp 22. In other words, the ball 20 traveling through the ramp 22 will not be located sufficiently close to the permanent magnet 52 to be retained thereby. Thus, to provide an interaction between the permanent magnet 52 and the ball 20 traveling on the ramp 22, the ramp 22 includes a deflector 80 that is selectively movable to acts as a "launch ramp" when the deflector 80 is in the operating position (see FIG. 6A).

Figure 4B:
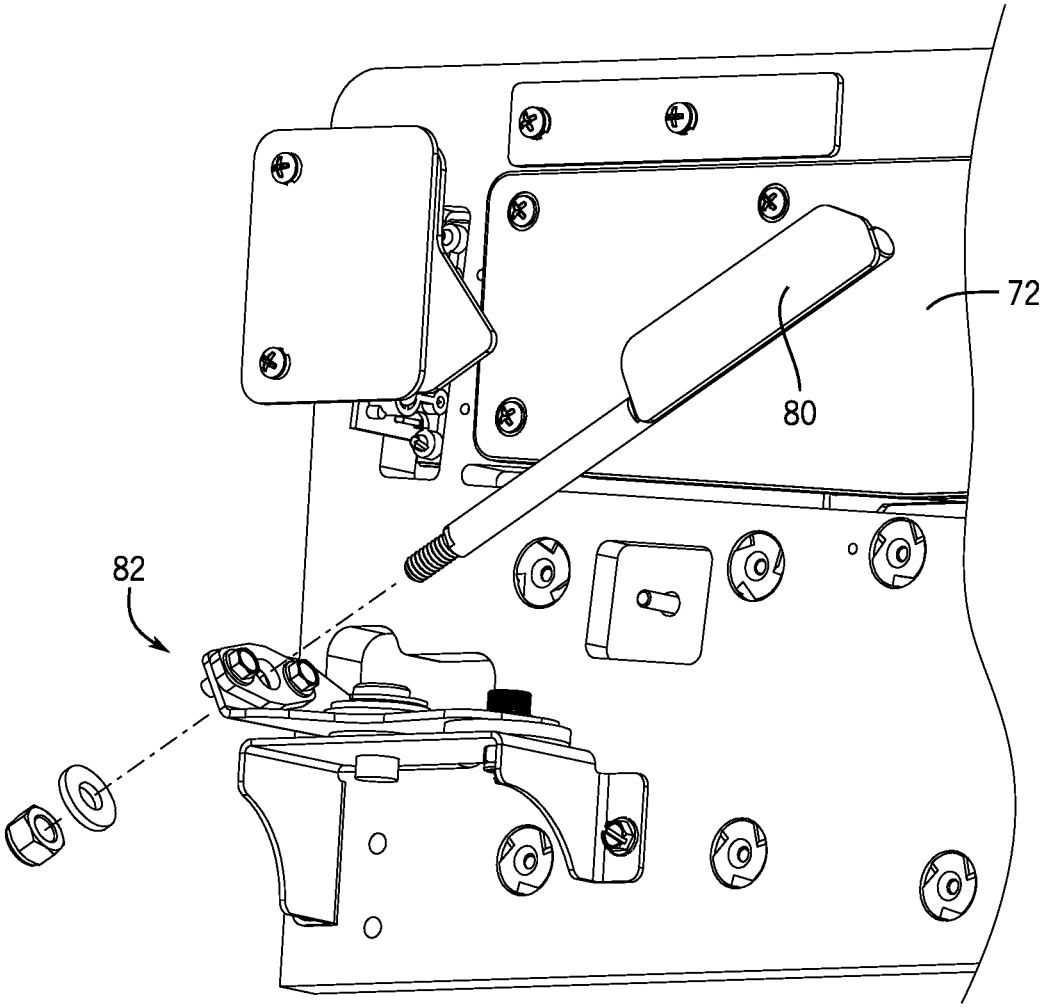
FIG. 4B is a perspective, partial exploded view of a front side of the example pinball playfield of FIG. 3.

More precisely, as shown in FIGS. 4A and 4B, the example deflector 80 is movably attached to the ramp 22 by a lever assembly 82 and a coil 84 (e.g., a solenoid and plunger assembly). As illustrated, the coil 84 is mounted to the backside 19*a* of the backpanel 19 by the fasteners 55 and is coupled to the lever assembly 82. The lever assembly 82 extends through the backpanel 19 and is coupled to the deflector 80. As constructed, the example deflector 80 is moved away from a launch position and into a stowed position (FIGS. 5A-5C and 7A-7C) during normal operation and any ball moving along the ramp 22 will travel along the ramp 22 without being diverted towards the permanent magnet 52. When activated, however, the coil 84 will influence the lever assembly 82 to pivot the deflector 80 into a launch position (FIGS. 6A-6C) and any ball traveling along the ramp 22 will be launched upwards and away from the ramp 22 and thus towards the permanent magnet 52.

As will be appreciated, the deflector 80 may be moved at any suitable time by the processing device 42 or suitable mechanical device, including by activation of a sensor when a ball is moving in a manner such that the ball may impact the deflector 80. In this example, a sensor, such as an optical sensor is located along the ramp and when a ball activates the sensor, the sensor causes the coil 84 to move the deflector. In this manner, any energy required to move the deflector 80 from its biased position is minimized. In combination with the permanent magnet 52 being moved to the operation position near the backpanel 19, any ball launched by the deflector 80 will be "captured" (e.g., stopped and held) by the permanent magnet 52.

Figure 5A:
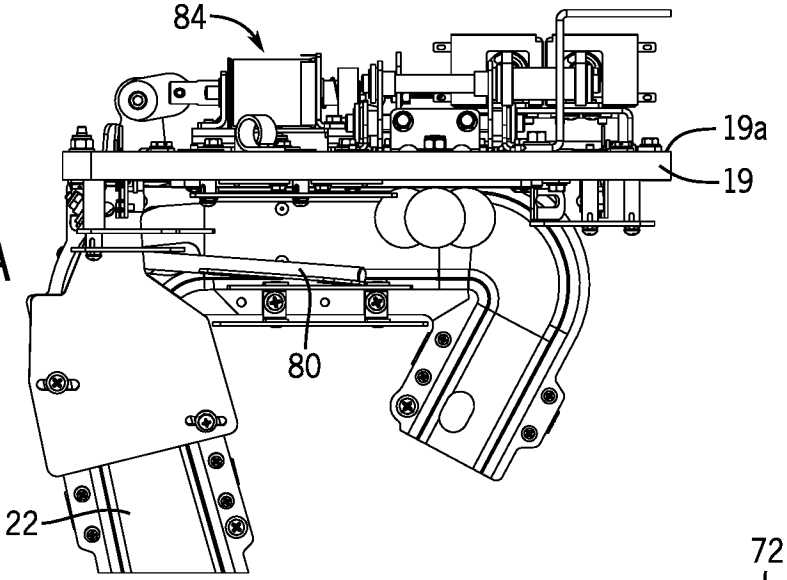
FIG. 5A is a top plan view of the example pinball playfield of FIG. 3 showing a deflector and a magnet each in a normal, rest position.
Figure 5C:
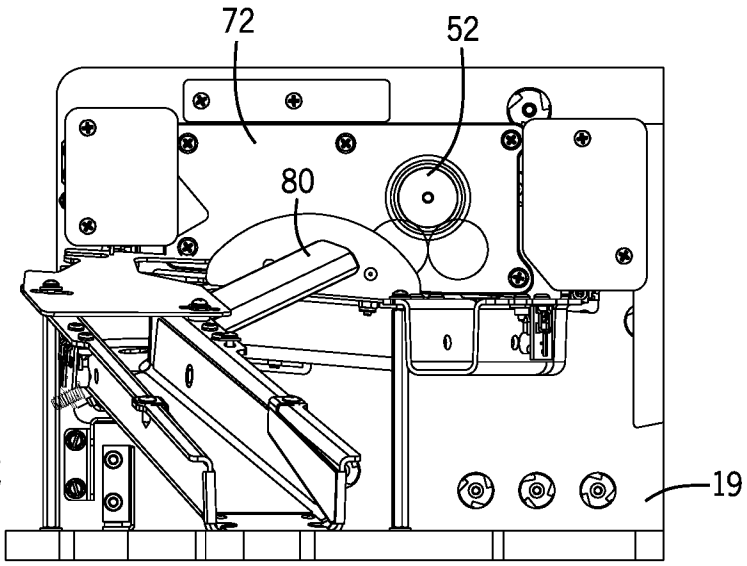
FIG. 5C is a front elevational view of FIG. 5A.
Figure 5B:
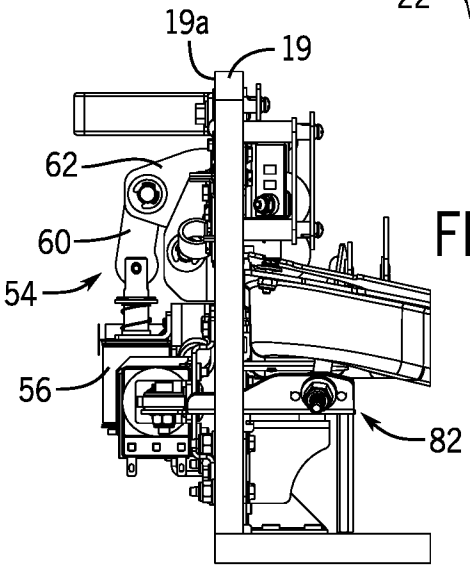
FIG. 5B is a side elevational view of FIG. 5A.
Figure 6A:
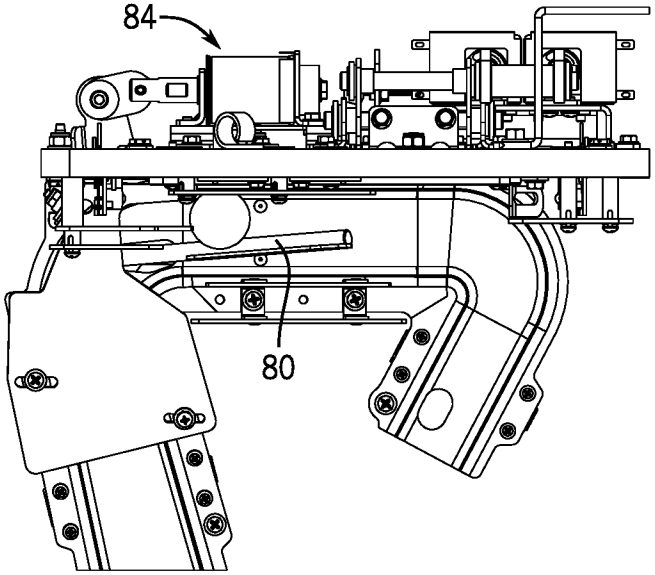
FIG. 6A is a top plan view of the example pinball playfield of FIG. 3 showing the deflector in an activated position and the magnet in a normal, rest position.
Figure 6C:
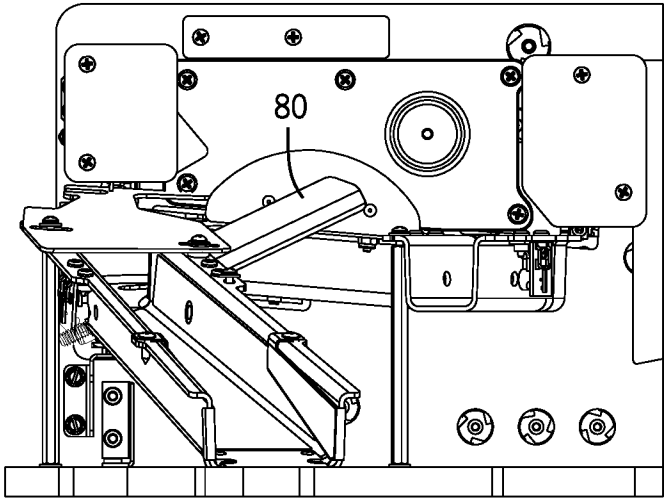
FIG. 6C is a front elevational view of FIG. 6A.
Figure 6B:
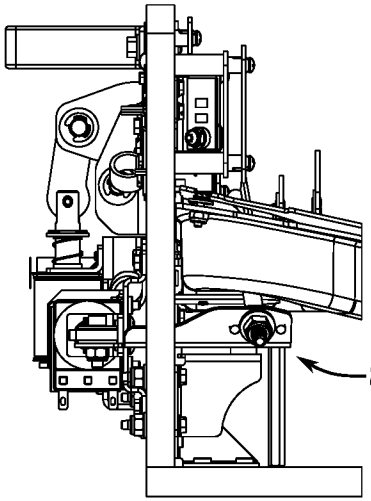
FIG. 6B is a side elevational view of FIG. 6A.

The permanent magnet 52 may be utilized to attract and retain a single ball, or multiple balls as shown in FIGS. 5A-5C. In addition, the permanent magnet 52 may be utilized to merely influence or change the path of the ball 20 and not necessary to "capture" the ball 20. Various sensors, including for instance an optical sensor, or any other suitable sensor, may be used to identify whether a ball is captured by the permanent magnet 52 and how many balls are captured. For example, the permanent magnet 52 may be configured to capture one or multiple balls and may be pivoted away from the wall into the non-operational position to release the ball(s) and activate a game feature such as multi-ball gameplay.

While the above examples are directed towards a permanent magnet assembly, the magnet may also be an electromagnet or combination of permanent and electromagnet as desired.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. An amusement device comprising:

a play surface; and a magnet assembly comprising:

a permanent magnet operably coupled to the play surface of the amusement device, the permanent magnet movable between a first position, where the permanent magnet is proximate the play surface and a second position, where the permanent magnet is distally located from the play surface;

a linkage assembly coupled to the permanent magnet; and an actuator coupled to the linkage assembly to move the permanent magnet between the first position and the second position.

2. The amusement device of claim 1, wherein the amusement device is a pinball machine.

3. The amusement device of claim 2, wherein the permanent magnet is pivotally coupled to the play surface.

4. The amusement device of claim 2, wherein the actuator is a coil and the coil is operably coupled to the linkage assembly via a plunger.

5. The amusement device of claim 4, wherein the coil is mounted to the play surface.

6. The amusement device of claim 4, wherein the linkage assembly comprises a first linkage coupled to the plunger, a plate operably coupled to the first linkage wherein the permanent magnet is mounted to the plate, and a mount operably coupled to the plate and mounted to the play surface.

7. The amusement device of claim 4, wherein the play surface is a vertical backpanel extending from a horizontal playfield.

8. The amusement device of claim 7, wherein the backpanel comprises a hollow configured to at least partially accept the permanent magnet therein when the permanent magnet is in the first position.

9. The amusement device of claim 7, wherein the magnet assembly is mounted to a backside of the backpanel and further comprising a ramp mounted to the horizontal playfield on an opposite side of the magnet assembly.

10. The amusement device of claim 9, wherein the ramp is configured to transport a ball moving within the ramp to a location proximate the permanent magnet when the permanent magnet is in the first position.

11. The amusement device of claim 10, wherein the ramp comprises a movable deflector, the deflector having a first deflector position wherein the ball moving within the ramp is not deflected and a second deflector position wherein the ball moving within the ramp is deflected closer to the permanent magnet than when not deflected.

12. The amusement device of claim 11, wherein the permanent magnet attracts the ball and stops movement of the ball when the ball is deflected.

13. A pinball machine comprising:

a generally horizontal playfield;

a generally vertical backpanel;

a ball movable relative to the playfield and the backpanel; and a magnetic playfield feature for selectively capturing the ball, the magnetic playfield feature comprising;

a permanent magnet mounted to a plate and disposed proximate a backside of the backpanel;

a link operably coupled to the plate;

a plunger coupled to the link; and a coil operably coupled to the plunger, wherein selective energization and de-energization of the coil causes the permanent magnet to move away from the backpanel and towards the backpanel, respectively.

14. The pinball machine of claim 13, wherein the plate of the magnetic playfield feature is pivotally mounted to the backpanel.

15. The pinball machine of claim 13, wherein the plate of the magnetic playfield feature is pivotally mounted to a mount coupled to the backpanel.

16. The pinball machine of claim 13, wherein the permanent magnet is at least partially inserted into a hollow formed in the backpanel when the permanent magnet is moved towards the backpanel.

* * * * *